US008601626B2

(12) United States Patent
Kim et al.

(10) Patent No.: US 8,601,626 B2
(45) Date of Patent: Dec. 10, 2013

(54) WASHING MACHINE AND METHOD OF OPERATING SAME

(75) Inventors: Deok Kyu Kim, Seoul (KR); Kyung Seop Hong, Seoul (KR); Bon Kwon Koo, Seoul (KR); Jae Chul Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 935 days.

(21) Appl. No.: 12/684,193

(22) Filed: Jan. 8, 2010

(65) Prior Publication Data

US 2010/0175199 A1 Jul. 15, 2010

(30) Foreign Application Priority Data

Jan. 9, 2009 (KR) ..... 10-2009-0001953

(51) Int. Cl.
*D06F 35/00* (2006.01)
*D06F 37/20* (2006.01)

(52) U.S. Cl.
USPC ..... 8/158

(58) Field of Classification Search
CPC .... D06F 37/203; D06F 35/007; D06F 39/003
USPC ..... 8/158–159; 68/12.06, 23.1
See application file for complete search history.

(56) References Cited

U.S. PATENT DOCUMENTS

| | | | | |
|---|---|---|---|---|
| 5,181,398 | A * | 1/1993 | Tanaka et al. | 68/12.06 |
| 2001/0054204 | A1 * | 12/2001 | Ciancimino et al. | 8/159 |
| 2002/0035757 | A1 * | 3/2002 | Ciancimino et al. | 8/159 |
| 2005/0108830 | A1 * | 5/2005 | Park et al. | 8/158 |
| 2005/0283919 | A1 * | 12/2005 | Kim | 8/158 |
| 2007/0039106 | A1 | 2/2007 | Stansel et al. | |

FOREIGN PATENT DOCUMENTS

| | | |
|---|---|---|
| CN | 1619042 A | 5/2005 |
| JP | 2007-236585 | 9/2007 |
| WO | WO 2009/031298 | 3/2009 |

OTHER PUBLICATIONS

European Search Report issued in EP Application No. 10150266.4 dated Sep. 17, 2010.
Chinese Office Action issued in CN Application No. 201010002099.0 dated Nov. 3, 2011.

* cited by examiner

*Primary Examiner* — Joseph L Perrin
(74) *Attorney, Agent, or Firm* — KED & Associates, LLP

(57) ABSTRACT

A washing machine and associated washing method are provided. The method may include rotating a drum, measuring and storing a vibration level of a cabinet while increasing a rotational speed of the drum, and measuring the vibration level of the cabinet after the rotational speed of the drum reaches a target rotational speed and determining whether or not the vibration level of the cabinet is greater than a set value. The method may then include adjusting the rotational speed of the drum if the vibration level is greater than the set value so as to minimize vibration and resonance in a support surface on which the washing machine is positioned.

10 Claims, 5 Drawing Sheets

WASHING MACHINE AND METHOD OF OPERATING SAME

This claims priority to Korean Application No. 10-2009-0001953 filed in Korea on Jan. 9, 2009, the entirety of which is incorporated herein by reference.

BACKGROUND

1. Field

This relates to a washing machine and a washing method, and more particularly, to a washing machine and washing method which reduce resonance in a support surface of the washing machine.

2. Background

Generally, a washing machine cleans laundry items by washing, rinsing, and spinning in order to separate dirt from the items using water, detergent and a mechanical operation. An agitator type washing machine washes laundry items by rotating a washing rod positioned at the center of the washing tub in left and right directions. A pulsator type washing machine washes laundry using friction force between the laundry items and water current generated by a circular plate shaped pulsator formed in a lower portion of the washing tub. A drum type washing machine washes laundry items by rotating a drum containing washing water, detergent and the laundry items.

In the drum type washing machine, a tub holding wash water therein is mounted within a cabinet, and a drum having the laundry items loaded therein is mounted within the tub, with a motor that rotates the drum being mounted at the rear of the tub. A drive shaft is axially connected to a rear side of the drum, passing through the tub. A lifter is mounted within the drum so as to lift laundry during a rotation of the drum.

Such a drum type washing machine generates vibration as the drum rotates during wash, rinse and spin cycles. In particular, if the drum is rotated at a high speed for a long time during spinning, excessive vibration may cause the support surface, such as the floor, on which the washing machine is positioned, to resonate.

BRIEF DESCRIPTION OF THE DRAWINGS

The embodiments will be described in detail with reference to the following drawings in which like reference numerals refer to like elements wherein.

DETAILED DESCRIPTION

Figure 1:
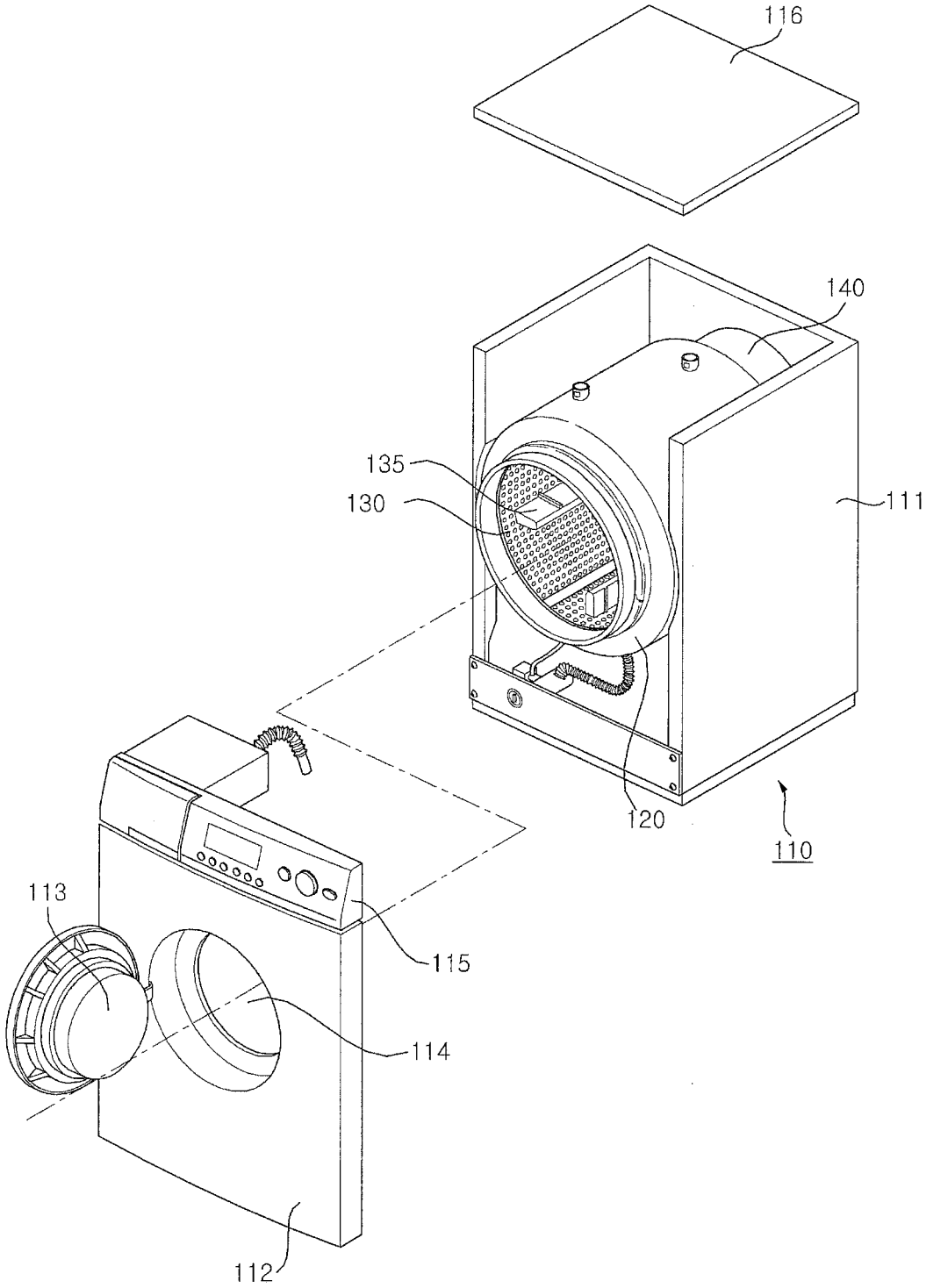
FIG. 1 is a perspective view of an exemplary washing machine according to an embodiment as broadly described herein.
Figure 2:
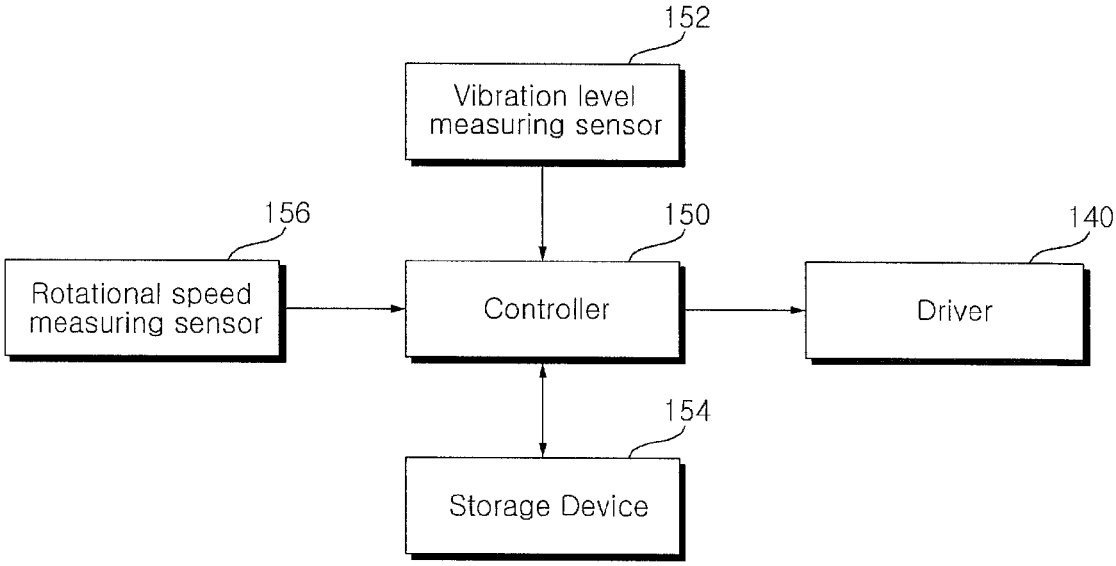
FIG. 2 is a block diagram of the washing machine shown in FIG. 1.

As shown in FIG. 1, an exemplary washing machine as embodied and broadly described herein may include a cabinet 110, a tub 120 disposed inside the cabinet, a drum 130 rotatably provided in the cabinet, a driver 140 for rotating the drum, and a control panel 115 for controlling an overall operation of the washing machine based on user input.

The cabinet 110 may include a cabinet main body 111, a cabinet cover 112 coupled to a front surface of the cabinet main body 111, and a top plate 116 coupled to a top surface the cabinet main body 111. The cabinet cover 112 may include an opening 114 for introducing laundry into the drum 130 and a door 113 rotatably coupled to the cabinet 110 cover so as to open and close the opening 114.

The tub 120 may be installed in the cabinet 110 and damped by springs and a damper. The tub 120 contains washing fluid during a wash cycle. The drum 130 may be installed in the tub 120 such that the drum 130 rotates with laundry therein. A plurality of holes that allow washing fluid to pass therethrough may be formed in the drum 130, and at least one lifter 135 may be provided on the drum 130 so as to lift the laundry by a predetermined height when the drum 130 rotates.

The driver 140 may rotate the drum 130 by applying a torque to the drum 130. The driver 140 may adjust the rotational speed of the drum 130 by changing the amplitude of the torque applied to the drum 130. The driver 140 may include, for example, a motor and a rotating shaft.

The control panel 115 provides for control of overall operation of the washing machine based on user input, and displays a current operation state. The control panel 115 may be provided on an upper portion of the cabinet cover 112. The control panel 115 may be provided with, for example, a manipulation button for receiving input, a microcomputer for controlling the operation of the washing machine, and a display. The microcomputer of the control panel 115 may be implemented as a controller 150 and a storage device 154.

A vibration level measuring sensor 152 may measure a vibration level of the cabinet 110, and a rotational speed measuring sensor 156 may measure a rotational speed of the drum 130. The vibration level of the cabinet 110 measured by the vibration level measuring sensor 152 may be stored in the storage device 154, and the controller 150 may adjust the rotational speed of the drum 130 by controlling the driver 140.

Various types of sensors for measuring a vibration level may be used as the vibration level measuring sensor 152 to measure the vibration level of the cabinet 110. For example, an accelerometer may be installed in a front-rear, left-right, or up-down direction to measure a vibration level in each direction. For purposes of discussion, it will be assumed that an accelerometer is installed in a left-right direction to measure a lateral vibration acceleration level of the cabinet 110.

In alternative embodiments, the vibration level measuring sensor 152 could measure a vibration level of the surface on which the washing machine is positioned. However, for ease of installation, in this embodiment the vibration level measuring sensor 152 measures a vibration level of the washing machine, assuming that a vibration level of the cabinet 110 is similar to the vibration level of the floor. Alternatively, the vibration level measuring sensor 152 may measure vibration levels of other parts, such as, for example, the tub 120.

The vibration level measuring sensor 152 may be a sensor installed on the tub 120 in order to measure vibration of the tub 120, or may be separately provided. In this exemplary embodiment, the vibration level measuring sensor 152 is separately provided on the control panel 115 so as to measure a vibration level of the cabinet 110. A vibration level measuring device could be installed on the floor in order to sense resonance of the floor where the washing machine is positioned. However, since the vibration level of the cabinet 110 increases if the floor resonates, the vibration level of the cabinet 110 may be measured by the use of the vibration level measuring sensor 152.

The vibration level measuring sensor 152 begins measuring the vibration level of the cabinet 110 when the rotational speed of the drum 130 is at a minimum. If the rotational speed of the drum 130 is too low, the vibration of the washing machine may be severe due to unbalance in the drum 130. Thus, at a speed less than the minimum rotational speed, the vibration level measuring sensor 152 may be controlled so that it does not measure a vibration level, or, the controller 150 may not store any measured vibration level which may be collected in the storage device 154. In certain embodiments, the minimum rotational speed may be about 450 RPM. Minimum rotational speed may be established for a particular washing machine configuration as appropriate.

In certain embodiments, the vibration level measuring sensor 152 measures the vibration level of the cabinet 110 each time the rotational speed of the drum 130 increases by a predetermined value. For example, the vibration level measuring sensor 152 may measure a vibration level each time the rotational speed of the drum 130 increases by approximately 50 RPM, starting from the minimum rotational speed. The vibration level measuring sensor 152 may take a vibration measurement at each predetermined interval, and the control unit 150 may store the vibration level measured in by vibration level measuring sensor 152 in the storage device 154 each time the rotational speed of the drum 130 increases by 50 RPM.

Various different types of sensors may be used as the rotational speed measuring sensor 156 to measure the rotational speed of the drum 130, such as, for example, a hall sensor. The rotational speed measuring sensor 156 may be provided in the drum 130 in order measure the rotational speed of the drum 130, or alternatively may be provided on the motor of the driver 140 to measure the rotational speed of the motor. The rotational speed measuring sensor 156 transmits the measured rotational speed of the drum 130 to the controller 150.

The storage device 154 stores the vibration level of the cabinet 110 measured by the vibration level measuring sensor 152 each time the rotational speed of the drum 130 increases by a predetermined value, starting from the minimum rotational speed. For example, the storage device 154 may store the vibration level of the cabinet 110 each time the rotational speed of the drum 130 increases by 50 RPM, starting from 450 RPM. Other staring points and intervals may also be appropriate.

The controller 150 adjusts the rotational speed of the drum 130 based on the vibration level of the cabinet 110 obtained when the drum 130 rotates at a target rotational speed. The controller 150 determines whether or not the vibration level of the cabinet 110 during rotation of the drum 130 at the target rotational speed is greater than a set value. The aforementioned target rotational speed may be, for example, a rotational speed of the drum 130 required for a particular operation, such as, for example, a washing operation. A target rotational speed required for each of wash, rinse and spin cycles may vary based on a washing course, the amount of laundry, the amount of washing fluid, and other such factors.

In certain embodiments, the controller 150 measures the vibration level of the cabinet 110 after a stabilization time period has elapsed so that the vibration of the drum 130 may be at a stabilized/representative level, and may be minimized. The stabilization time period may be, for example, about 10 seconds. In alternative embodiments, the stabilization time period may be much shorter or longer.

The controller 150 may determine whether or not the vibration level of the cabinet 110 during rotation of the drum 130 at the target rotational speed is greater than a vibration level of for example, about 150 μm, and adjust the rotational speed of the drum 130 accordingly.

The controller 150 may also determine whether the vibration level stored in the storage device 154 is rising or falling and adjust the rotational speed of the drum 130 accordingly. In this embodiment, the controller 150 determines whether the vibration level stored in the storage device 154 is rising or falling, and adjusts the rotational speed of the drum 130 when the vibration level of the cabinet 110 is greater than a set value. In alternative embodiments, the controller 150 may determine whether the vibration level stored in the storage device 154 is rising or falling regardless of the set value. The controller 150 may then rotate the drum 130 at a rotational speed at which the vibration level is minimized based on the vibration level stored in the storage device 154.

A method for washing according to an exemplary embodiment as broadly described herein will now be discussed with reference to FIG. 3.

When the drum 130 beings to rotate to initiate a particular cycle, the controller 150 controls the driver 140 to increase the rotational speed of the drum 130 (S311). The drum 130 may begin to rotate in order to perform any one of wash, rinse and spin cycles. Simply for ease of discussion, the spin cycle will be discussed in this exemplary embodiment.

The controller 150 identifies whether the rotational speed of the drum 130 is at the minimum rotational speed (S312), for example, a minimum rotational speed of 450 RPM. The controller 150 receives the rotational speed of the drum 130 measured by the rotational speed measuring sensor 156, and if the rotational speed of the drum 130 has not reached the minimum rotational speed, continues to increase the rotational speed of the drum 130 (S311).

If the rotational speed of the drum 130 meets or exceeds the minimum rotational speed, an amount of lateral vibration of the cabinet 110 is measured and stored (S313). The measured amount of lateral vibration of the cabinet 110 is transmitted to the controller 150, and the controller 150 stores it in the storage device 154.

The controller 150 then determines whether or not the rotational speed of the drum 130 is a target rotational speed (S314). The target rotational speed is a specific, individual rotational speed of the drum 130 required to perform each of the wash, rinse and spin cycles. In this exemplary embodiment, the target rotational speed is a rotational speed required to perform the spin cycle. If the rotational speed of the drum 130 does not reach the target rotational speed, the controller 150 controls the driver 140 to increase the rotational speed of the drum 130 by a predetermined amount (S315), and again measures and stores the amount of lateral vibration of the cabinet 110 (S313). In this exemplary embodiment, the rotational speed of the drum 130 may be increased by, for example, 50 RPM (S315). For the exemplary spin cycle, the target rotational speed may be 800 RPM, which may vary depending upon a particular model or type of washing machine previously discussed.

If the rotational speed of the drum 130 is at the target rotational speed, stabilization is performed (S316). The stabilization period may be, for example, 10 seconds. Once stabilization is completed, the vibration level measuring sensor 152 measures an amount of lateral vibration of the cabinet 110, and the controller 150 determines whether or not the measured amount of lateral vibration is greater than a set value (S317). The set value may be, for example, 150 μm. The set value may be smaller or larger than 150 μm for a spin cycle.

In alternative embodiments, step S317 may be omitted. If omitted, the step 319 may be carried out after stabilization (S316). That is, the drum 130 may be rotated at a rotational speed at which the vibration level is minimized without comparison between the measured vibration level and the set value.

If the amount of lateral vibration is less than the set value, the current rotational speed is maintained (S321) and the corresponding cycle is carried out.

If the amount of lateral vibration is greater than the set value, the controller 150 identifies the amount of lateral vibration of the cabinet 110 stored in the storage device 154 and determines whether the vibration level is on an increasing trend or a decreasing trend (S318). Based on the trend of the vibration level, the rotational speed of the drum 130 is adjusted to a rotational speed which is closer to the target rotational speed and at which the vibration level is closer to a minimum.

If the vibration level is on an increasing trend, the controller 150 decreases the rotational speed of the drum 130 (S319) to a rotational speed at which the vibration level stored in the storage device 154 is minimum, within a range less than the target rotational speed. For example, the rotational speed may be reduced by 150 RPM, or other amount as appropriate. After the speed of the drum 130 is decreased, the controller 150 carries out the corresponding cycle while maintaining the rotational speed of the drum 130 (S321). A detailed description thereof will be given later with reference to FIG. 5B.

If the vibration level is on a decreasing trend, the controller 150 increases the rotational speed of the drum 130 (S320). The controller 150 estimates a rotational speed at which the vibration level will be at a minimum based on the vibration level and rotational speed data stored in the storage device 154, controller within a range greater than the target rotational speed by, for example, 150 RPM. The controller 150 increases the rotational speed of the drum 130 to the estimated rotational speed. After the speed of the drum 130 is increased, the controller 150 carries out the corresponding cycle while maintaining the rotational speed of the drum 130 (S321).

Figure 4:
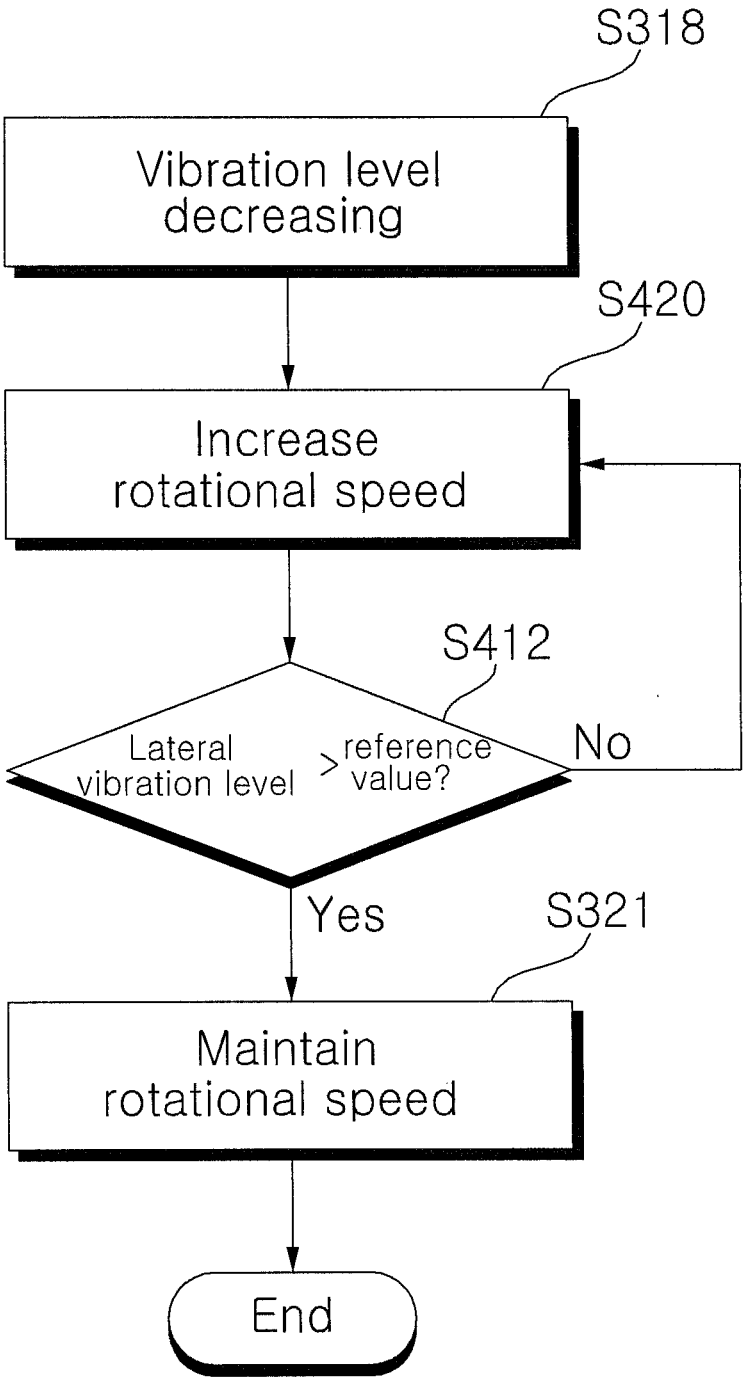
FIG. 4 is a detailed sequence diagram of one of the steps of FIG. 3 of a washing method according to another embodiment as broadly described herein.

FIG. 4 is a detailed flow diagram of step, S320 for the washing method.

Figure 3:
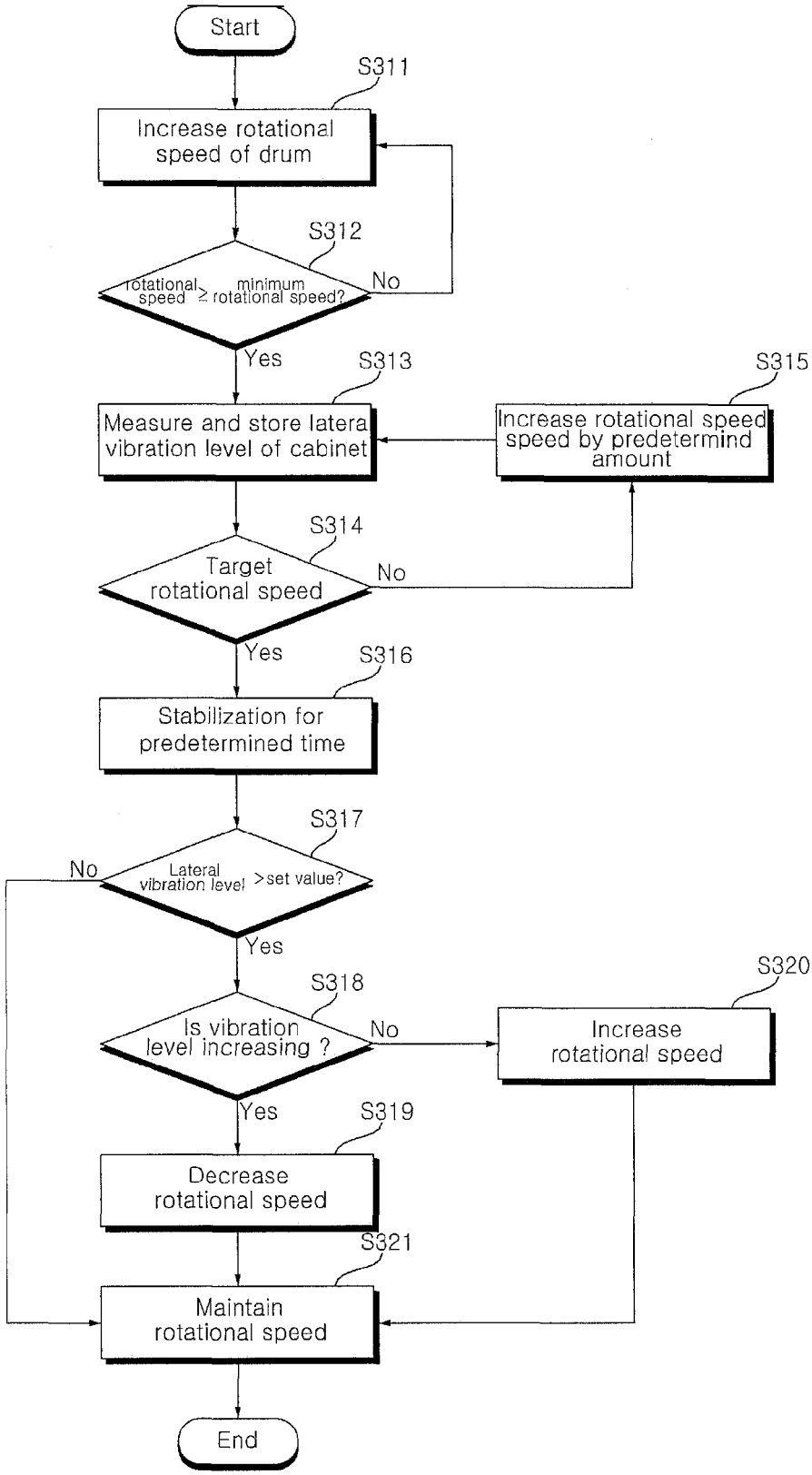
FIG. 3 is a sequence diagram of an exemplary washing method according to an embodiment as broadly described herein.

In the step S318 shown in FIG. 3, if the vibration level is decreasing, in the embodiment shown in FIG. 4, the controller 150 increases the rotational speed of the drum 130 (S420). The vibration level measuring sensor 152 measures an amount of lateral vibration of the cabinet 110 while increasing the rotational speed of the drum 130, and the controller 150 determines whether or not the measured amount of lateral vibration is greater than a reference value (S412). The aforementioned reference value may be, for example, less than or equal to 150 μm, and may be a maximum value of lateral vibration that does not cause inconvenience to the user. If the amount of lateral vibration is less than the reference value, the controller 150 increases the rotational speed of the drum 130 (S420). The rotational speed of the drum 130 may be increased such that the rotational speed of the drum 130 is not greater than a target rotational speed by a predetermined amount, such as, for example, 150 RPM.

If the amount of lateral vibration is greater than the reference value, the controller 150 carries out the corresponding cycle while maintaining the rotational speed of the drum 130 (S321).

After the step S321, the step. S317 described above with reference to FIG. 3 may be carried out again to avoid a resonance which may occur due to a change in the environment. However, if some amount of time, for example, about 30 seconds, elapses after the step S321, the rotational speed of the drum 130 may be maintained without the need for additional resonance avoidance steps.

Figure 5A:
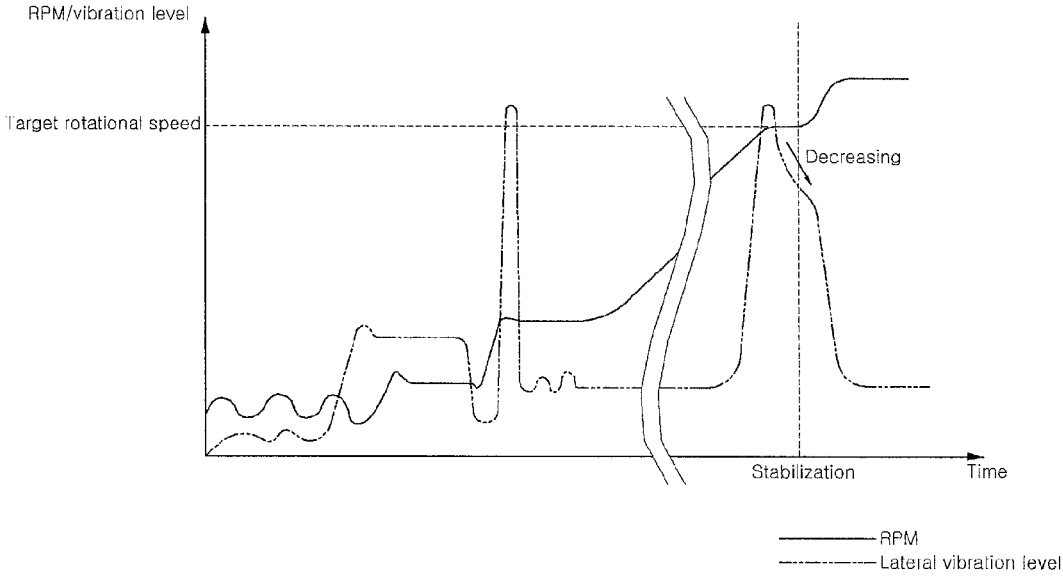
FIGS. 5A-5B are graphs of changes in rotational speed and lateral vibration level with time using a method as embodied and broadly described herein.

As shown in FIG. 5A, if the amount of lateral vibration of the cabinet 110 is decreasing during stabilization, the rotational speed of the drum 130 is increased to minimize the amount of lateral vibration and hence avoid resonance.

Figure 5B:
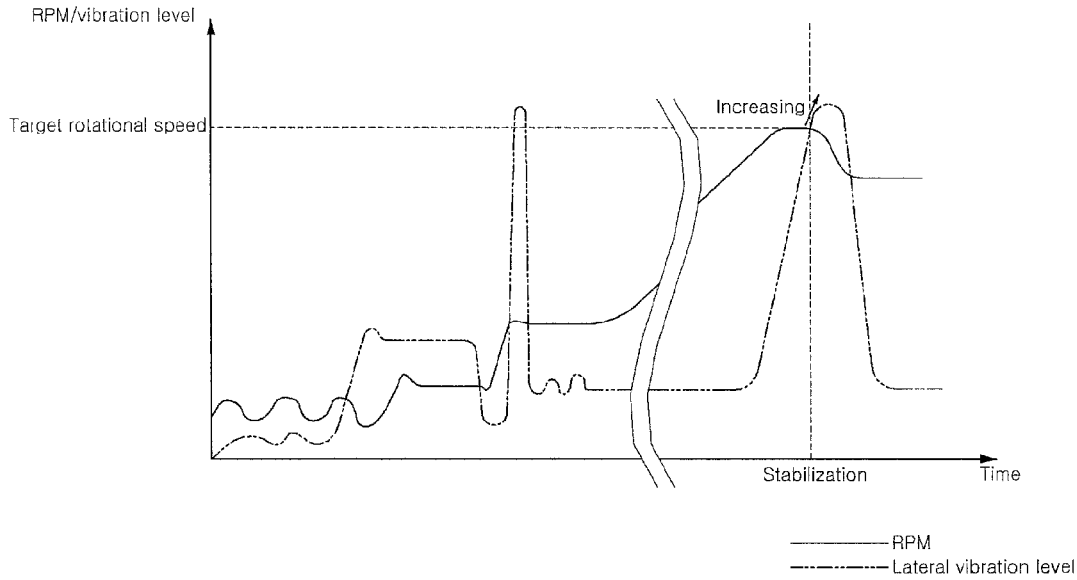

As shown in FIG. 5B, if the amount of lateral vibration of the cabinet 110 is increasing during stabilization, the rotational speed of the drum 130 is decreased to minimize the amount of lateral vibration and hence avoid resonance.

A method for washing according to an exemplary embodiment as broadly described herein may include a step (a) of measuring and storing a vibration level of a washing machine while increasing the rotational speed of a drum; a step (b) of the measuring vibration level of the washing machine after the rotational speed of the drum reaches a target rotational speed; and a step (c) of adjusting the rotational speed of the drum based on the vibration level stored in step (a) and the vibration level measured in step (b).

A washing machine according to an exemplary embodiment as broadly described herein may include a cabinet forming an external appearance; a drum rotatably provided in the cabinet to hold laundry; a drive unit for rotating the drum; a vibration level measuring sensor for measuring a vibration level of the cabinet; a storage unit for storing the vibration level measured by the vibration level measuring sensor while increasing the rotational speed of the drum; and a control unit for adjusting the rotational speed of the drum by controlling the drive unit on the basis of the vibration level of the cabinet measured when the drum rotates at a target rotational speed.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of operating a washing machine, the method comprising:

rotating a drum;

incrementally increasing a rotational speed of the drum;

detecting a vibration level at each of the incremental rotational speeds and storing the detected vibration levels;

reaching a target rotational speed and detecting a corresponding vibration level at the target rotational speed;

comparing the detected vibration level at the target rotational speed to a set value;

if the vibration level at the target rotational speed is greater than the set value, determining whether the detected vibration level is increasing or decreasing at the target rotational speed based on the stored vibration levels and the detected vibration level at the target rotational speed; and adjusting the rotational speed of the drum depending on whether the detected vibration level is increasing or decreasing at the target rotational speed.

2. The method of claim 1, wherein detecting a vibration level at each of the incremental rotational speeds and storing the detected vibration levels in a memory comprises detecting and storing a lateral vibration level of a cabinet in which the drum is installed, beginning at a point at which the drum is at a minimum rotational speed.

3. The method of claim 1, wherein detecting a vibration level at each of the incremental rotational speeds and storing the detected vibration levels in a memory comprises detecting and storing a new vibration level of the washing machine each time the rotational speed of the drum increases by a predetermined value.

4. The method of claim 3, wherein detecting and storing a new vibration level of the washing machine each time the rotational speed of the drum increases by a predetermined value comprises:

detecting an initial vibration level at a minimum rotational speed of approximately 450 rpm; and detecting a new vibration level each time the rotational speed increases by approximately 50 rpm until the drum reaches the target rotational speed.

5. The method of claim 1, wherein reaching a target rotational speed and detecting a corresponding vibration level at the target speed comprises detecting the vibration level of the washing machine after a stabilization time period has elapsed after the target rotational speed has been reached.

6. The method of claim 1, wherein adjusting the rotational speed of the drum comprises decreasing the rotational speed of the drum if the detected vibration level on the increase.

7. The method of claim 6, wherein decreasing the rotational speed of the drum comprises decreasing the rotational speed of the drum to a rotational speed corresponding to a minimum vibration level within a variable rotational speed range.

8. The method of claim 1, wherein adjusting the rotational speed of the drum comprises increasing the rotational speed of the drum if it is determined that the vibration level is decreasing at the target rotational speed.

9. The method of claim 8, wherein increasing the rotational speed of the drum comprises increasing the rotational speed of the drum within a variable rotational speed range by estimating a current rotational speed of the drum based on the stored vibration levels.

10. The method of claim 8, wherein increasing the rotational speed of the drum comprises increasing the rotational speed of the drum within a variable rotational speed range until the vibration level is less than a reference value.

* * * * *